United States Patent [19]

Kögler

[11] 4,076,685

[45] Feb. 28, 1978

[54] CYANOACRYLATE FOUNDRY BINDERS AND PROCESS

[75] Inventor: Hubert P. Kögler, Metzkausen, Germany

[73] Assignee: Ashland Oil, Inc., Ashland, Ky.

[21] Appl. No.: 326,648

[22] Filed: Jan. 26, 1973

[30] Foreign Application Priority Data

Jan. 25, 1972 Germany ..... 2203411

[51] Int. Cl.[2] ..... C08K 3/36

[52] U.S. Cl. ..... 260/42.53; 164/43; 260/DIG. 40

[58] Field of Search ..... 260/41 A, 78.4 N, 42.53, 260/DIG. 40; 164/43

[56] References Cited

U.S. PATENT DOCUMENTS

| | | | |
|---|---|---|---|
| 2,765,332 | 10/1956 | Coover | 260/464 |
| 2,794,788 | 6/1957 | Coover | 260/17 |
| 3,008,205 | 11/1961 | Blaies | 260/42.53 |
| 3,409,579 | 11/1968 | Robins | 260/DIG. 40 |
| 3,428,110 | 2/1969 | Walker et al. | 260/DIG. 40 |
| 3,442,851 | 6/1969 | McManimie | 260/41 |
| 3,663,493 | 4/1972 | Miller | 260/31.8 M |
| 3,663,501 | 4/1972 | Adams | 260/41 R |
| 3,734,936 | 4/1973 | Brown | 260/395 B |
| 3,745,139 | 7/1973 | Kochur | 260/38 |
| 3,896,077 | 7/1975 | Leonard et al. | 260/42.48 |

*Primary Examiner*—Sandra M. Person

[57] ABSTRACT

The invention relates to foundry core or mold compositions containing thermoplastic cyanoacrylate polymer material as binder and to the process for polymerizing the binder so as to set or harden said foundry compositions by eliminating the inhibiting effect of polymerization inhibitors present in the binder.

31 Claims, No Drawings

CYANOACRYLATE FOUNDRY BINDERS AND PROCESS

BACKGROUND OF THE INVENTION

Preferred compositions employed heretofore for binding sand in forming foundry cores or molds have included water-producing condensation reaction products, addition reaction products of at least two components, or time-consuming oxidative polymerizations. These reactions have in practice been carried out with the familiar phenol-, furan- or phenol-isocyanate, urea-formaldehyde resins and core oils.

Examples of condensation reactions in which monomeric and/or oligomeric furfuryl alcohol are employed as binders or as a binder ingredient in which the binder is hardened or set at room temperature in forming foundry cores or molds in the presence of acids are found in Swiss Pat. No. 451,413, in U.S. Pat. No. 3,145,438, in German Publication Patent No. 1,190,144, and in the British Pat. No. 832,999. Examples of acids used in those processes are: Volatile acids, HCl and as nonvolatile acids, $H_3PO_4$.

A characteristic of the process of Swiss Pat. No. 451,413 is the use of a water solution of the acid hardening agent for the binder, which water solution as initially charged is of insufficient concentration to trigger a quick setting of the binder. Water is evaporated by passing air through the solution and the acid concentration increases to the point where setting of the binder is initiated. The water is not an inhibitor in such a process, it is a mere diluent for the acid.

British Pat. No. 768,887 describes a process for hardening or curing of thermosetting foundry binders wherein a mixture of furfuryl alcohol and maleic acid anhydride containing an ammonium chloride additive is caused to react. The ammonium chloride has the function of a latent curing catalyst or precursor, in that at elevated temperatures it will decompose to $NH_3$ and HCl and the latter then acts as a curing catalyst.

Also, there are binders for foundry cores or molds based on water-soluble polymeric acrylates and methacrylates and/or polyacrylonitrile (See the discussion in Chemisches Zentralblatt 1961 — chemical review, page 12, 988; Swedish Pat. No. 155,354; German Application Pat. No. 1,164,604; German Pat. No. 880,388). These all involve preformed polymerisates wherein the setting or hardening of the binder mixed with foundry sand takes place slowly as the water evaporates. The evaporation of the water requires a relatively long time resulting in correspondingly long setting times.

SUMMARY OF THE INVENTION

The present invention provides cold-setting (that is, room temperature polymerizable) binders and foundry compositions of same containing sand which binders can be limited to a single hardening or polymerizable material wherein the setting of the binder can be regulated so as to be made to occur at the desired time by controlling the conditions. This is achieved by the present invention by a binder comprising a polymerizable monomer or oligomer (oligomer being defined hereinafter) containing a polymerization inhibitor which can be readily eliminated by physical or chemical means.

The term polymerizable monomers or oligomers of the present invention is distinguished from the prior art condensation type monomers, such as furfuryl alcohol, by the presence of reactable double bonds.

The polymerizable monomers or oligomers of this invention will polymerize or harden spontaneously upon removal of the polymerization inhibitor, resulting in a high initial strength and, unlike the prior preformed thermoplastics employed in water solution, an adhesive bond with the foundry sand and cohesive bond within the binder is formed.

The inhibitor may be removed or deactivated in various ways; by physical means, for example, by pressure reduction, by blowing, or by adsorption; or chemically, for example, neutralization. As long as the inhibitor is present, the binder composition of this invention remains workable. The foundry binder comprises as the polymerizable monomer at least one cyanoacrylic acid ester of the general formula

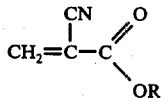

wherein R stands for an alkyl, cycloalkyl, aralkyl, aryl or alkaryl group and/or, a polymerizable oligomer, (an oligomer of the aforementioned cyanoacrylic acid ester means a low molecular weight polymer, preferably of a workable viscosity without the use of a solvent). The group R of the cyanoacrylic acid ester may be an alkyl group with 1–16 carbon atoms, preferably with 1–5 carbon atoms, a cyclohexyl group or a phenyl group.

The esters of the 2-cyanoacrylic acid can be employed either alone or in combination. The preferred ester is ethyl-2-cyanoacrylate used alone.

Preferred inhibitors are volatile Lewis acids (for example $SO_2$), although other stabilizers or polymerization inhibitors for cyanoacrylates are known and can be employed. For example a non-volatile Lewis acid and/or the corresponding anhydrides (for example, propane sultone), or a free radical inhibitor (for example hydroquinone), certain dyes (for example bromophenol blue or thymol blue) can also be employed. In general any compounds which react with Lewis bases can be employed. However the most preferred inhibitor is $SO_2$.

Usually core or mold compositions comprised of sand and binder contain about 0.4–10 wt. % of binder, and preferably about 1–3 wt.% of binder is employed, based on the total mixture. Also the binder in the foregoing compositions contain usually about 0.001–1 wt.% inhibitor, and preferably the inhibitor is employed in the range of 0.001–0.1 wt.%.

Since the amount of inhibitor employed is very small, for example, 0.001–0.1 wt.% because such amounts of $SO_2$ is sufficient to stabilize cyanoacrylic acid ester, the inhibitors are in turn easily driven off and/or only small amounts of Lewis bases are required for their neutralization so as to bring about polymerization.

The foundry sand according to the invention may also contain one or more additives to increase the viscosity of the binder, or plasticizer(s) to soften the polymerized product and/or additives that improve the adhesion of the binder to sand grains.

A certain viscosity of the binder is frequently desired in order to obtain better adhesion to the sand grains, which also prevents binder run-off from the sand grain prior to setting. Especially preferred is a viscosity of 100 cP. Additional binder components such as acrylic and phenolic resins as well as cellulose ester and polyvinyl ether compounds may be used to vary the viscosity and to reduce the brittleness of the hardened binder.

Known softeners or plasticizers in this respect, such as alkyl esters of polybasic acids (for instance of phosphoric acids (for instance of phosphoric acid, phthalic acid, adipic acid, etc.), polyalkyl ether or polyurethanes can be used to reduce the brittleness of the polymerized or set cores or molds. The amount of the aforementioned additives or components varies depending on the desired result, however, it is generally in the range of about 1–50%.

The bonding to the sand grain can be improved through the use of siloxanes known to improve binder adhesion to sand of the general formula

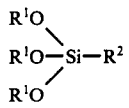

In this formula, $R^1$ stands for a hydrocarbon radical, $R^2$ for an alkyl radical, or an alkoxy- or alkylamine-substituted alkyl radical. When used in a concentration of 0.1–2%, based on the binder components, the aforementioned siloxanes give improved adhesion to the sand grains.

One specific aspect of the present invention is to provide a process for polymerizing or setting the foundry cores or mold forming compositions suitable for setting in cold equiment; or otherwise stated, suitable for setting in equipment not required to be equipped for heating above ambient temperatures since such temperatures are not required because the polymerization inhibitor can be driven off, absorbed, or neutralized at ambient conditions.

The polymerization at ambient or room temperature, and thus the setting of the foundry compositions in cold core or mold forming equipment, can be catalyzed by the application, to the core or mold compositions containing the inhibited binder, of very small amounts of nucleophilic substances, for example of Lewis bases, in order to neutralize the inhibitor as previously discussed. Specific suitable nucleophilic substances are preferably gaseous or volatile substances, for instance ammonia or amines. A specific embodiment of the invention consists of the evaporation of tertiary amines, such as trimethylamine, tryethylamine or dimethyl ethylamine, in a flow of air, $CO_2$ or inert gas and/or in the introduction of ammonia into such a gas flow, and passing the latter through the sand and binder compositions. The gas flows used may have a content of about 0.001–5% by volume of a volatile or vaporizable Lewis base. When using $CO_2$ as carrier gas, which is a weak Lewis acid it has only a slightly inhibiting effect, which is obviated by the ammonia and/or the amines, which are strong bases.

Also, the inhibitor may as well be evaporated or volatilized to achieve setting of the binder, by storing the molds or cores at room temperature. In such situations the setting can be accelerated by passing a cold or hot gas flow, for instance air, through the molds or cores. The air used for that purpose may also contain water vapor since it catalyzes the polymerization.

To aid release of the polymerized compositions of this invention from the equipment used for shaping same, a separating agent, such as petroleum or silicone oil, is preferably incorporated. These separating agents may be added in quantities of 0.1–1 wt. %, based on the sand.

It is apparent that many modifications and variations of the invention as hereinbefore set forth may be made without departing from the spirit and scope thereof. The examples given are by way of illustration only, and the invention is limited only by the terms of the appended claims.

EXAMPLE 1

150 g quartz sand were mixed for one minute with 0.5 $cm^3$ petroleum solvent. Added thereafter were 3 g of ethyl-2-cyanoacrylate inhibited with $SO_2$ (0.05%), which was followed by one more minute of mixing. Made with this sand mixture was a nonbending body and set aside for air-drying, wherein the $SO_2$ evaporated and the polymerization of the ethyl-2-cyanoacrylate began. The specimen displayed a hard surface already after one hour. Bending strength after 12 hours: 28 $kp/cm^2$.

EXAMPLE 2

The sand treated according to example 1 (150 g) was mixed with 2 g of $SO_2$-inhibited ethyl-2-cyanoacrylate and then compacted by 3 tamping blows. The specimen was hardened with 0.1 ml of triethylamine in a flow of $CO_2$. The setting time was 5 seconds, the shearing strength after 75 minutes was 5 $kp/cm^2$.

EXAMPLE 3

Added to 150 g of sand were 2 g of ethyl-2-cyanoacrylate inhibited with 0.05% $SO_2$ and then mixed for one minute. The sand mixture was compacted by 3 tamping blows in a bending stress form and, while in it, treated with 0.2 ml of dimethyl ethylamine in a $CO_2$ flow. The setting time amounted to 5 seconds, the bending strength was immediately 2 $kp/cm^2$. The bending strength after 15 hours amounted to 4 $kp/cm^2$.

EXAMPLE 4

Added to 150 g of quartz sand were 0.3 $cm^3$ petroleum, followed by a mixing of one minute. Mixed in over 30 seconds were then 2 g of ethyl-2-cyanoacrylate inhibited with 0.05% $SO_2$. Made thereof was a crushing test specimen which was exposed to a mixture from ammonia and nitrogen (nitrogen flow through concentrated ammonia solution) for 15 seconds at 20° C. The immediate crushing strength was 5 $kp/cm^2$. When using nitrogen alone, a partial setting is obtained.

EXAMPLE 5

150 g of quartz sand were blended for one minute with 2 g of a phenol resin, to which then 2 g of ethyl-2-cyanoacrylate (inhibited with 0.05% $SO_2$) were added, followed by 45 more seconds of blending. The setting was effected with 0.3 $cm^3$ of triethylamine in a flow of air within 10 seconds; immediate crushing strength: 3 $kp/cm^2$.

EXAMPLE 6

A crushing test specimen was made according to example 4, with air of 27° C blown through it thereafter for 2 minutes. Obtained was an immediate crushing strength of 11.7 $kp/cm^2$.

EXAMPLE 7

A crushing test specimen was made according to example 7, thereafter humid air of about 50° C blown through it. The setting occurred within 30 seconds; immediate crushing strength: 7 $kp/cm^2$.

EXAMPLE 8

150 g quartz sand were mixed with 2 g of metal-2-cyanoacrylate inhibited with 0.01% hydroquinone and 0.5% propane sultone. The crushing test specimen made from this mixture was gassed with 0.3 $cm^3$ of triethylamine in a $CO_2$ flow and showed after a setting time of 1 hour a crushing strength of 4 $kp/cm^2$.

EXAMPLE 9

Added to 150 g of quartz sand were 2 g of cyclohexyl-2-cyanoacrylate inhibited with 0.05% $SO_2$. The crushing test specimen made from this mixture as described in example 9 was cured with triethylamine. Crushing strength after 1 hour: 5 $kp/cm^2$.

EXAMPLE 10

Admixed to 150 g of quartz sand were 2 g of ethyl-2-cyanoacrylate inhibited with (a) 0.5% bromophenol blue and 0.1% hydroquinone and/or (b) with 0.5% thymol blue and 0.1% hydroquinone. The crushing test specimen made from this mixture as described in example 9 was cured with triethylamine. Crushing strength after 1 hour: 4 $kp/cm^2$ in both cases.

While particular embodiments of the invention have been described, it will be understood, of course, that the invention is not limited thereto, since many modifications may be made; and it is therefore contemplated to cover by the appended claims any such modifications as fall within the true spirit and scope of the invention.

What is claimed is:

1. A foundry mix containing sand as the major constituent and a binding amount of up to 10% based on the weight of the sand of a polymerizable binder comprising a cyanoacrylate and a small but effective amount of a polymerizable inhibitor.

2. A foundry mix according to claim 1 wherein the cyanoacrylate is a cyanoacrylic acid ester monomer of the general formula

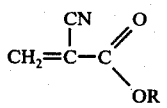

wherein R stands for an alkyl, cycloalkyl, aralkyl, aryl or alkaryl group of 1–16 carbon atoms or, a polymerizable oligomer of one of the aforementioned cyanoacrylic acid esters or a combination of at least one of said monomers and oligomers.

3. A foundry mix according to claim 2 wherein said binder contains a Lewis acid as an inhibitor.

4. A foundry mix according to claim 3 wherein said inhibitor is a volatile Lewis acid.

5. A foundry mix according to claim 4 wherein said inhibitor is $SO_2$.

6. A foundry mix according to claim 5 wherein said binder is present in about 1–3% by weight.

7. A foundry mix according to claim 3 wherein said binder contains about 0.001 – 1 wt.% of inhibitor based on the weight of the binder.

8. A foundry mix according to claim 7 wherein said binder contains about 0.001 – 0.1 wt.%.

9. A foundry mix according to claim 6 wherein said binder contains about 0.001 – 0.01 wt.% of $SO_2$

10. A foundry mix according to claim wherein said binder contains propane sultone as an inhibitor.

11. A foundry mix according to claim 1 wherein said binder contains hydroquinone as an inhibitor.

12. A foundry mix according to claim 2 wherein said binder contains a cyanoacrylic acid wherein R contains from 1–6 carbon atoms.

13. A foundry mix according to claim 2 wherein said binder contains a cyanoacrylic acid ester wherein R is an alkyl of 1–5 carbon atoms.

14. A foundry mix according to claim 9 wherein said binder contains a cyanoacrylic acid ester wherein R is an alkyl of 1–5 carbon atoms.

15. A foundry mix according to claim 14 wherein said binder is ethyl-2-cyanoacrylate.

16. A foundry process for cold-setting of foundry mixes containing sand and a polymerizable binder comprising a cyanoacrylic acid ester and a small but effective amount of a polymerization inhibitor which process comprises placing said foundry mix in a shaping device or equipment and shaping same, then removing or neutralizing the polymerization inhibitor.

17. A foundry process according to claim 16 wherein said inhibitor in said binder is removed by evaporating same.

18. A foundry process according to claim 17 wherein said inhibitor of said binder is neutralized by gassing same with a Lewis base.

19. A foundry process according to claim 18 wherein said Lewis base is ammonia or an amine.

20. A foundry process according to claim 19 wherein said Lewis base is an amine.

21. A foundry process according to claim 20 wherein said Lewis base is a gaseous or vaporizable tertiary amine.

22. A foundry process according to claim 21 wherein said amine is present in a carrier gas stream in an amount in the range of about 0.001–5% by volume based on said gas stream.

23. The foundry process according to claim 22 wherein said carrier gas is air.

24. The foundry process according to claim 22 wherein said carrier gas is $CO_2$.

25. A foundry process according to claim 17 wherein said inhibitor in said binder of claim 6 is removed by gassing same with a Lewis base.

26. A foundry process according to claim 17 wherein said inhibitor in said binder of claim 8 is removed by gassing same with a Lewis base.

27. A foundry process according to claim 17 wherein said inhibitor in said binder of claim 14 is removed by gassing same with a Lewis base.

28. A foundry process according to claim 17 wherein said inhibitor in said binder of claim 15 is removed by gassing same with a Lewis base.

29. A foundry process according to claim 22 wherein the Lewis base is trimethyl amine.

30. A foundry process according to claim 22 wherein the Lewis base is triethyl amine.

31. A foundry process according to claim 22 wherein the Lewis base is diethyl methyl amine.

* * * * *

UNITED STATES PATENT AND TRADEMARK OFFICE

CERTIFICATE OF CORRECTION

PATENT NO. : 4,076,685
DATED : February 28, 1978
INVENTOR(S) : Hubert P. Kogler

It is certified that error appears in the above—identified patent and that said Letters Patent is hereby corrected as shown below:

Column 6, lines 3 and 4, delete "A foundry mix according to claim wherein said binder contains propane sultone as an inhibitor" and insert -- A foundry mix according to claim 1 wherein said binder contains propane sultone as an inhibitor --.

Signed and Sealed this

*Eighth* Day of *July 1980*

[SEAL]

*Attest:*

SIDNEY A. DIAMOND

*Attesting Officer*

*Commissioner of Patents and Trademarks*